US010088233B2

(12) United States Patent
Mathis, Jr. et al.

(10) Patent No.: US 10,088,233 B2
(45) Date of Patent: Oct. 2, 2018

(54) VIBRATORY DRYER WITH MIXING APPARATUS

(71) Applicant: GENERAL KINEMATICS CORPORATION, Crystal Lake, IL (US)

(72) Inventors: Oscar L. Mathis, Jr., Cary, IL (US); Tobin Lane Imes, Crystal Lake, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 518 days.

(21) Appl. No.: 14/167,416

(22) Filed: Jan. 29, 2014

(65) Prior Publication Data

US 2014/0208606 A1 Jul. 31, 2014

Related U.S. Application Data

(60) Provisional application No. 61/759,388, filed on Jan. 31, 2013.

(51) Int. Cl.

| | |
|---|---|
| ***F26B 25/04*** | (2006.01) |
| ***F26B 3/092*** | (2006.01) |
| ***F26B 15/00*** | (2006.01) |

(52) U.S. Cl.

CPC ..... *F26B 25/04* (2013.01); *F26B 3/0923* (2013.01); *F26B 15/00* (2013.01)

(58) Field of Classification Search

CPC ..... F26B 15/00; F26B 25/04; F26B 3/0923

See application file for complete search history.

(56) References Cited

U.S. PATENT DOCUMENTS 3,401,465 A * 9/1968 Larwill ..... B01J 8/10 34/586
3,592,395 A * 7/1971 Lockwood ..... A23L 3/50 159/DIG. 3

(Continued)

FOREIGN PATENT DOCUMENTS

| | | |
|---|---|---|
| CA | 2546587 | 6/2005 |
| CN | 202393184 | 8/2012 |

(Continued)

OTHER PUBLICATIONS

General Kinematics, VIBRA-DRUM brochure (6 pages) (1999, USA).

(Continued)

*Primary Examiner* — Kenneth Rinehart
*Assistant Examiner* — Logan Jones
(74) *Attorney, Agent, or Firm* — Cook Alex Ltd.

(57) ABSTRACT

A vibratory dryer includes a conveying surface over which a bed of materials to be dried is conveyed, the surface having an inlet end and an outlet end, and passages through which air passes through the conveying surface to pass through the bed of materials on the conveying surface, a source of heated air coupled to the passages to supply heated air to the bed through the passages, and a vibration generator coupled to the conveying surface. The dryer also includes at least one rotary mixer having an impeller spaced from the conveying surface at a distance so as to be disposed within the bed, the at least one rotary mixer disposed along the length of the conveying surface between the inlet end and the outlet end. The at least one rotary mixer is adapted to provide uplift within the bed without de-densification of the bed.

16 Claims, 12 Drawing Sheets

(56) References Cited

U.S. PATENT DOCUMENTS 3,646,689 A * 3/1972 Kuchenthal ..... F26B 17/20 198/625
3,815,255 A * 6/1974 Yamato ..... F26B 17/26 34/580
3,989,227 A 11/1976 Musschoot
4,033,555 A * 7/1977 Fong ..... B01J 8/44 366/101
4,075,766 A * 2/1978 Michel ..... F26B 3/0923 34/166
4,306,359 A 12/1981 Hoyt
4,389,978 A 6/1983 Northcote
4,415,444 A 11/1983 Guptail
4,444,553 A * 4/1984 Christodoulou ..... A23F 5/046 432/134
4,561,598 A 12/1985 Musschoot
4,608,766 A * 9/1986 Kawai ..... F26B 3/084 34/179
4,646,759 A 3/1987 Thatcher et al.
4,709,507 A 12/1987 Musschoot
4,712,312 A * 12/1987 Christodoulou ..... B01F 7/028 198/676
4,724,779 A 2/1988 White et al.
4,901,652 A 2/1990 Pressnall et al.
4,926,601 A 5/1990 Musschoot
RE33,542 E 2/1991 Musschoot
5,512,008 A 4/1996 Musschoot
5,536,203 A 7/1996 Takeyoshi et al.
5,591,074 A 1/1997 Musschoot
5,713,345 A 2/1998 Bentsen et al.
5,775,237 A 7/1998 Reilly et al.
6,189,234 B1 * 2/2001 Luker ..... F26B 3/0923 34/166
6,241,951 B1 6/2001 Musschoot et al.
6,578,468 B1 * 6/2003 Horn ..... A23L 1/0114 366/144
6,743,386 B2 6/2004 Lease
6,745,705 B1 6/2004 Benesch et al.
8,984,762 B2 * 3/2015 Trojosky ..... F26B 25/04 34/166
2003/0217960 A1 * 11/2003 Casey ..... B01D 33/0361 210/255
2005/0115477 A1 6/2005 Magaldi
2007/0108023 A1 5/2007 Mathis et al.
2009/0126219 A1 5/2009 Mathis, Jr. et al.

FOREIGN PATENT DOCUMENTS

EP 0063486 10/1982
EP 0931981 7/1999
WO WO 97/00406 1/1997
WO WO 2005/052482 6/2005

OTHER PUBLICATIONS

International Search Report and Written Opinion, corresponding International Application No. PCT/US2014/013581, dated Apr. 17, 2014.

* cited by examiner

VIBRATORY DRYER WITH MIXING APPARATUS

BACKGROUND

This patent is directed to drying systems and methods, and, in particular, to vibratory drying systems and methods utilizing mixing apparatuses.

Municipal solid waste (MSW) may include a variety of materials. For example, there may be lighter-weight materials, such as paper and newsprint. Solid waste may also include heavier-weight materials, such as metal, plastic and glass containers. Also, there may be organic materials, such as vegetation and the like.

There is interest in obtaining further value from MSW, by collecting the recoverable and/or recyclable materials from MSW, for example. Alternatively, there is interest in separating the combustible elements out from the remainder of the MSW, and then burning the separated combustible elements as a fuel source, to provide heat, for example. However, the moisture content of MSW may defeat both attempts to separate MSW into its constituent materials, as well as to use the combustible materials as a fuel source.

Similar remarks may be made in regard to other "waste" products that otherwise would be disposed of in landfills or in some other fashion because the products cannot be put to a commercial use. These products may include a variety of materials of lighter and heavier weight. These products may include organic materials, such as vegetation and the like. These product may have a high moisture content, which may make these "waste" products difficult to separate and difficult to burn or combust.

If a method and apparatus can be found to treat such waste products, two pressing societal issues may be addressed at one time. That is, such a method and apparatus may assist in providing a new fuel source to meet the energy requirements of a growing global population while at the same time limiting the impact of that growing population on the environment in which it lives. Additionally, the new source of fuel may be considered to be renewable, in that it is capable of being replenished in a short amount of time, as opposed to fossil fuels that take many centuries to develop.

However, the methods and apparatuses disclosed herein could be used to separate mixed products, and specifically mixed products with high moisture content, without that product being classified as a "waste" product. Moreover, the methods and apparatuses disclosed here may separate mixed products without addressing the societal issues mentioned above.

BRIEF DESCRIPTION OF THE DRAWINGS

It is believed that the disclosure will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION OF VARIOUS EMBODIMENTS

Figure 1:
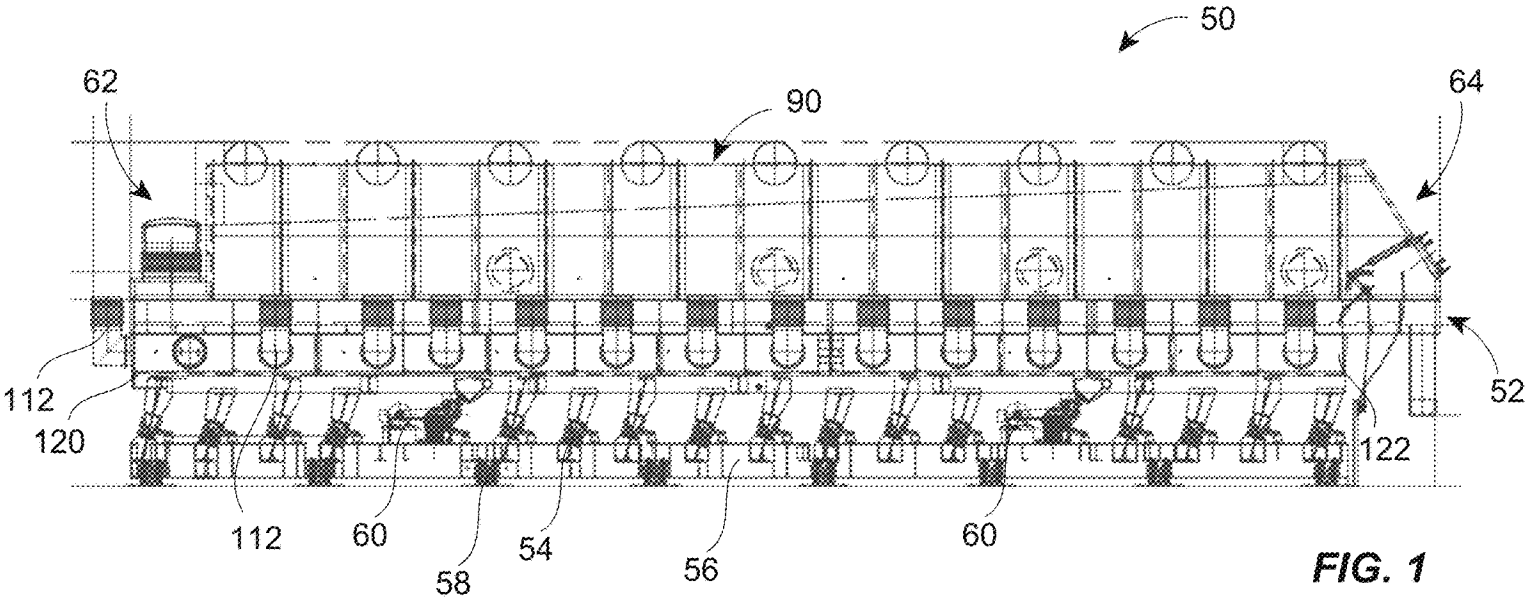
FIG. 1 is a side view of a fluidized bed dryer according to the present disclosure.

As illustrated in the attached drawings, a first embodiment of the present disclosure relates to a vibratory dryer in the form of a vibratory fluidized bed dryer that includes a trough that defines a conveying surface on which a bed of materials to be dried is formed and over which the bed is conveyed. The trough has an inlet end and an outlet end, which define the inlet and outlet ends of the conveying surface. The trough also has at least one deck plate with apertures that define passages through which air passes through the trough (and the conveying surface) to pass through the bed of materials (such as MSW) in the trough (and on the conveying surface). Consequently, the dryer also includes a source of heated air coupled to the passages in the trough (and conveying surface) to supply heated air to the bed through the passages.

To move the bed of materials along the trough between the inlet end and the outlet end, the dryer includes a vibration generator coupled to the trough, and in particular the conveying surface.

The dryer also includes at least one rotary mixer, and may include a plurality of mixers. The mixer has an impeller that is disposed in the trough and spaced from the conveying surface at a distance so as to be disposed within the bed of materials formed in the trough. The plurality of rotary mixers is disposed along the length of the trough between the inlet end and the outlet end (and thus between the inlet and outlet ends of the conveying surface). The plurality of rotary mixers is adapted to provide uplift within the bed without causing de-densification of the bed. By providing uplift (and thereby enhancing mixing) without causing de-densification (and thereby avoiding the formation of a barrier layer within the material that inhibits flow the drying air within the material), the dryer according to the present disclosure may produce uniform drying at a constant rate (within an acceptable range) along the length of the dryer.

As is also illustrated in the attached drawings, a second embodiment of the present disclosure relates to a vibratory dryer in the form of a container having a curved inner surface disposed about a generally horizontally extending longitudinal axis that defines the conveying surface. The container has an inlet end and an axially-spaced outlet end opposite the inlet end, which inlet and outlet ends define the inlet and outlet ends of the conveying surface. The curved inner surface may be defined, at least in part, by at least one deck plate that has a plurality of apertures through which air passes through the conveying surface and thus passes through the bed of materials on the conveying surface. According to certain embodiments, the air passing through the apertures may be directed tangential to the curved inner surface. In any event, the dryer may also include a source of heated air coupled to the deck plate and the passages to supply heated air to the container through the passages defined by the apertures in the deck plate.

To move a bed of materials along the container between the inlet end and the outlet end, the dryer also includes a vibration generator coupled to the container, and in particular the conveying surface. The generator produces a vibratory force to cause the material within the container to be moved in a generally rising and falling path of rolling movement along the curved inner surface.

The dryer also includes at least one rotary mixer. The mixer has an impeller that is disposed in the container at a distance so as to be disposed within the bed of materials formed in the container along the curved inner surface. The mixer may be disposed along the length of the container between the inlet end and the outlet end. The mixer is adapted to provide uplift within the bed without causing de-densification, such as described above. Unlike the rotary mixer of the first embodiment, the rotary mixer of the second embodiment is directed along an axis that may be parallel to or coincident with the axis of the container, such that the impeller(s) of the mixer (and in particular, the blades of the impeller(s)) may be disposed within the material as it rises and falls along a path of rolling movement along the curved inner surface of the container.

The first embodiment of a dryer 50 according to the present disclosure is illustrated in FIG. 1. The dryer 50 includes a trough 52 that is supported on a series of resilient member/link (also referred to as reactor spring/stabilizer) pairs 54 to a frame 56. In turn, the frame 56 is supported on the ground (e.g., a concrete floor) by a further plurality of resilient members (also referred to as isolation springs) 58 to limit the transmission of the vibrations of the dryer 50, and in particular the trough 52, to the floor. Also illustrated in FIG. 1 are one or more (as illustrated, two) vibration generators 60 (e.g., rotating eccentric drives) coupled to the trough 52 to move materials along the trough 52 between an inlet end 62 and an outlet end 64.

Figure 2:
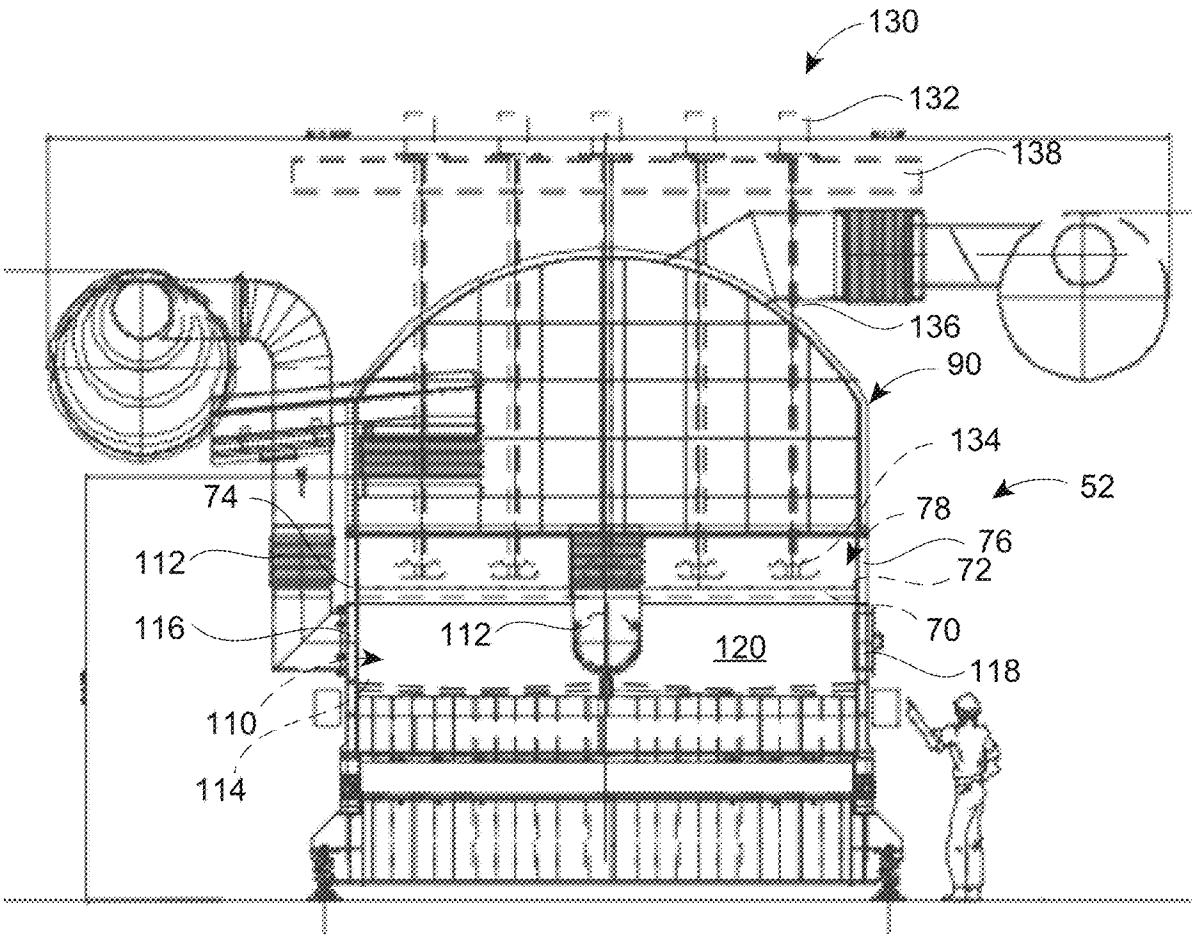
FIG. 2 is a end view of the fluidized bed dryer of FIG. 1, including one row of mixers.

Referring now to FIGS. 1 and 2, it will be recognized that the trough 52 has a deck 70 (defined by at least one deck plate) with a conveying surface 72 on which material may be disposed. The trough 52 may also include two opposing side plates 74, 76 that depend from the deck 70, and that may be attached or joined to the deck 70. The plates 74, 76 and the deck 70 may define a space 78 in which a bed of material may be formed. While the deck 70 and side plates (or walls) 74, 76 define a rectangularly-shaped cross-section, upwardly-opening space 78, this should not be viewed as limiting the trough 52 described herein, but merely exemplary of the possible constructions that may be used for the trough 52. Additionally, a moveable weir or gate may be disposed at the outlet end 64 to assist in forming the bed on the deck 70.

A hood 90 is attached to the trough 52 to limit the escape of materials from the bed defined by the trough 52, as well as to collect the heated air that has pass through the material bed. In particular, the hood 90 may be attached or secured to the side plates 74, 76 so as to be disposed above the deck 70 of the trough 52.

The trough 52 may also include one or more plenums 110 attached or defined below the deck 70. In turn, the plenum(s) 110 may be coupled, via flexible connectors 112 and conduits, to the source of the heated air, as explained in greater detail below with reference to FIG. 3. The plenum(s) 110 may be defined by a bottom plate (or wall) 114, side plates (or walls) 116, 118, and end plates 120, 122 (only one of which is illustrated in FIG. 2), as well as the deck 70. According to certain embodiments, the side walls 116, 118 of the plenum 110 may be formed by the same structural elements that defined the side walls 74, 76 of the trough 52 (i.e., a common plate may define both side wall 74 and 116, for example).

Heated air passes from the plenum(s) 110 through the deck 70 into the space 78 in which the bed of material is formed. In particular deck 70 may include at least one deck plate with openings, apertures, passages or the like through which heated air passes from the plenum(s) 110 into the space 78. To this extent, the deck 70 or the at least one deck plate may be described as perforated or foraminous.

As will also be recognized from FIG. 2, the dryer 50 includes one or more rotary mixer assemblies or mixers 130. Each mixer 130 includes a drive unit 132, which may include an electric motor and associated gearing, that is coupled to an impeller 134 by a shaft 136. As illustrated, the length of the shaft 136 is such that the drive unit 132 of the mixer 130 may be disposed outside the trough 52 and hood 90. For example, the drive units 132 of the mixers 130 may be mounted on a cross beam 138, which beam 138 may be connected to ground, and the shaft 136 may pass through the hood 90. A seal may be formed at each of the openings through which the shafts 136 pass through the hood 90. In fact, according to certain embodiments, the shafts 136 may be mounted on a spring-supported, weighted base to minimize the impact forces between the mixer 130 and the trough 52 due to material compression between the mixer 130 and the deck 70.

The drive unit 132 causes the shaft 136 to rotate about its longitudinal axis, causing the impeller 134 of the mixer to likewise rotate about that axis in a plane that is substantially parallel to the surface 72 of the deck 70. Because the drive units are coupled to ground, and the deck 70 (along with the remainder of the trough) is moving according to a vibratory motion, the impeller 134 will also have a tendency to move relative to the surface 72 through the bed of material disposed on the surface 72. Additionally, as the heated air passes through the bed of material, the air flow may cause the materials to shift, which may also cause relative movement between the impeller 134 and the materials within the bed.

The mixers 130 rotate relatively slowly to produce an uplift of the material (e.g., MSW) to mix the constituent materials within the bed without centrifugally displacing the material. As a consequence, the distribution of heated air across the face of the bed remains relatively uniform. The uniform distribution of the heated air is believed to play a significant role in achieving uniform constant rate drying.

Figure 4:
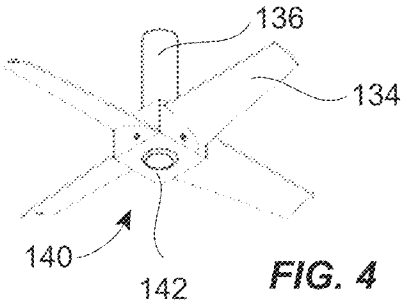
FIG. 4 is a perspective view of an exemplary impeller that may be used with fluidized bed dryer according to FIG. 1.
Figure 5:
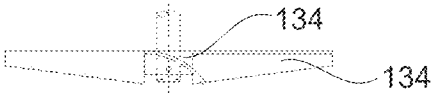
FIG. 5 is side view of the exemplary impeller of FIG. 4.
Figure 6:
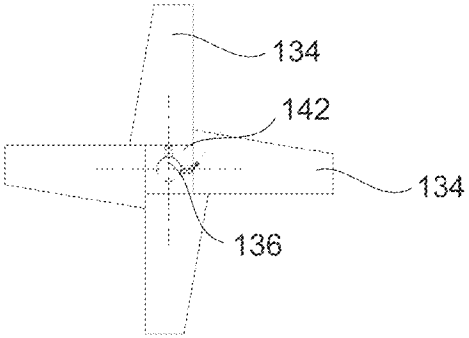
FIG. 6 is a plan view of the exemplary impeller of FIG. 4.

An end 140 of an exemplary embodiment of the mixer 130 is illustrated in the enlarged views of FIGS. 4-6 to better visualize the impeller 134. According to this embodiment, the impeller 134 includes four blades 142 mounted to a central hub 144 that is attached or secured in turn to the shaft 136. The blades 142 may have an arcuate shape, as best seen in FIG. 5, and may be equally disposed about the hub 144, as best seen in FIG. 6. It will be recognized that this embodiment of the mixer 130 is merely for illustrative purposes only, and does not limit the mixer 130 according to the present disclosure to only the embodiment illustrated in FIGS. 4-6.

Figure 7:
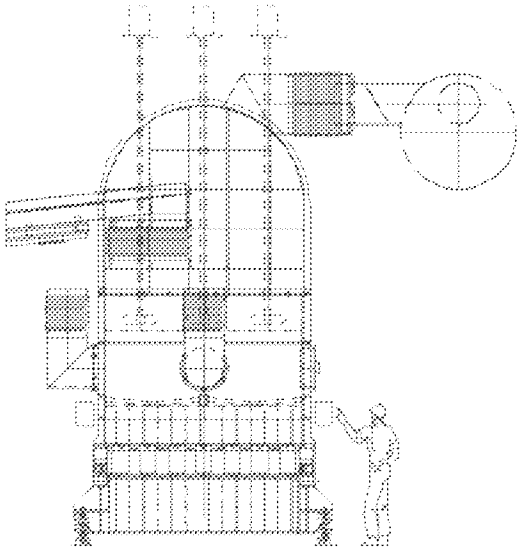
FIG. 7 is an end view of a fluidized bed dryer according to the present disclosure, illustrating a different arrangement of the mixers.
Figure 8:
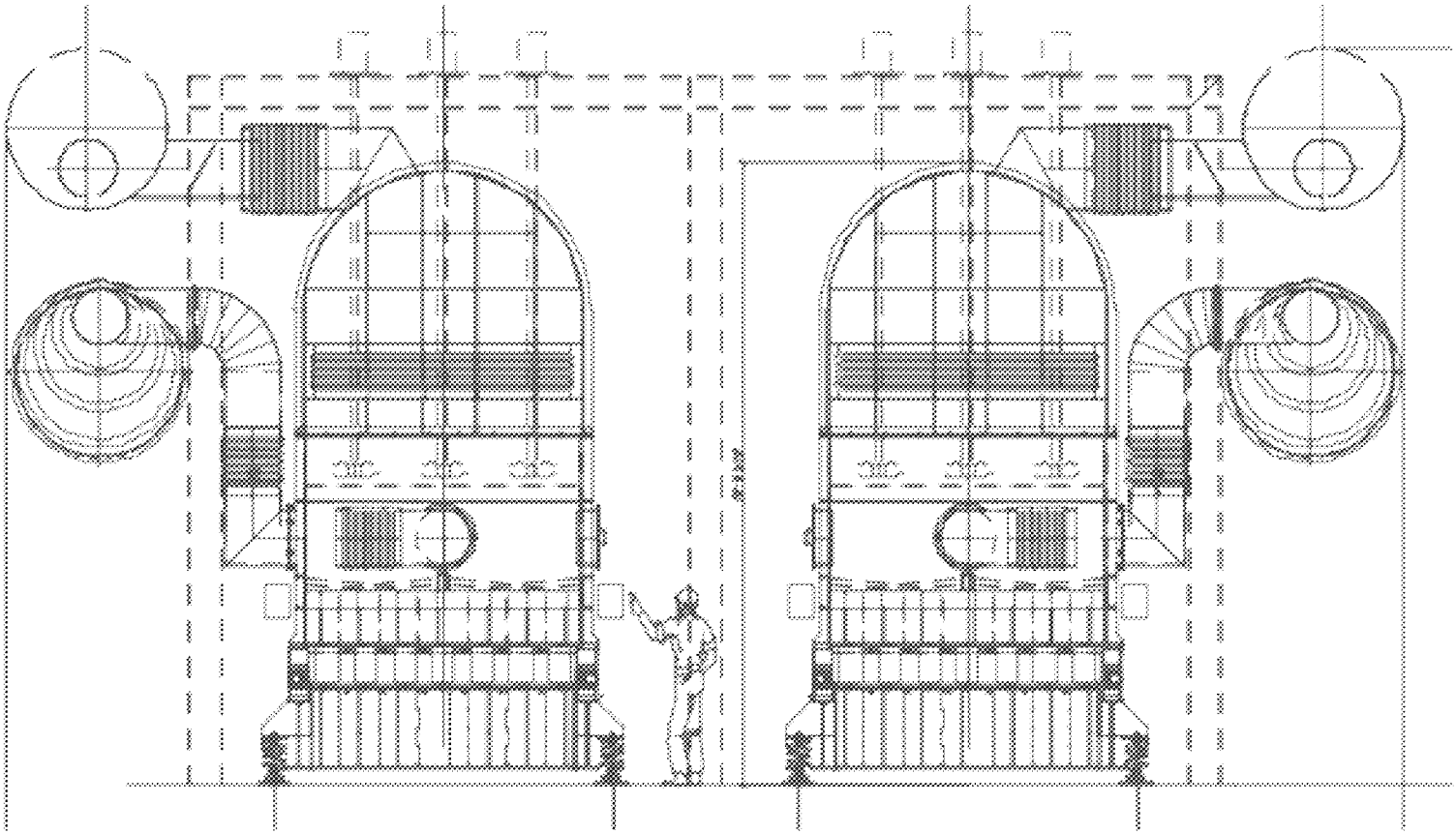
FIG. 8 is an end view of a system incorporating a plurality of fluidized bed dryers according to the present disclosure.

As also will be recognized from FIG. 2, according to certain embodiments, the mixers 130 are arranged in rows across the width (i.e., between the side walls 74, 76) of the trough 52. While five mixers 130 are illustrated in the row of mixers 130 in FIG. 2, the number of mixers 130 include in a row may vary; FIGS. 7 and 8 illustrate embodiments wherein the dryers include only three mixers per row. Additionally, while the mixers 130 are illustrated in FIGS. 2, 7 and 8 with the respective impellers 134 equally spaced between the side walls 74, 76, this is not true of the dryer according to all such embodiments; the spacing may vary between every mixer 130 in a row, or between only certain mixers 130 within a row. Moreover, while the mixers 130 are described as arranged in rows, this description does not require that each of the mixers 130 within a given row is equally spaced relative to the inlet and outlet ends 62, 64; mixers 130 described as within a given row may be staggered relative to each other, such that certain mixers 130 in a row are closer to the inlet end 62, while others are closer to the outlet end 64.

Furthermore, rows of mixers 130 may be disposed at intervals between the inlet and outlet ends 62, 64. For example, a plurality of rows may be spaced at equal intervals between the inlet and outlet ends 62, 64. According to this embodiment, each of the rows within this plurality of rows may have the same number of mixers 130. According to other embodiments, the spacing between different rows within the plurality of rows may be unequal, or the number of mixers 130 within different rows may be unequal. For example, the spacing between a first and a second row may vary relative to the spacing between the second row and a third row. Similarly, adjacent rows may alternate between even and odd numbers of mixers 130 in each row.

Figure 3:
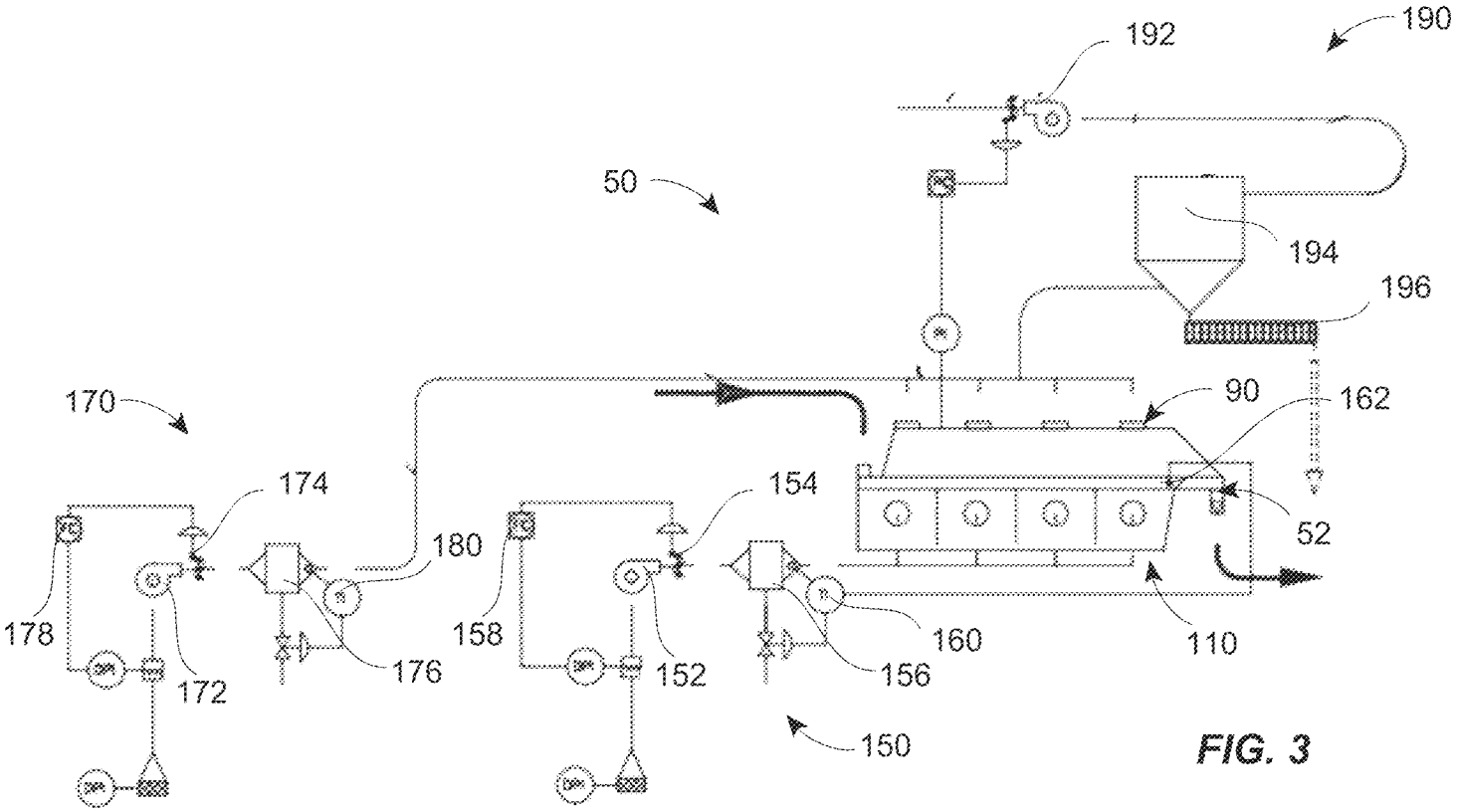
FIG. 3 is a schematic view of the fluidized bed dryer of FIG. 1, illustrating the source of heated air used in the dryer of FIG. 1.

As stated previously, the dryer 50 includes a source of heated air coupled to the plenum(s) 110, an exemplary embodiment of which is illustrated in FIG. 3. The illustrated source 150 includes a fan 152 and an associated damper 154 in combination with an air heater 156 (which may be a natural gas-fired air heater, for example). The damper 154 (or more particularly, the actuator associated with the damper 154) may be coupled to an air mass flow controller 158, which may be programmed to provide a constant mass flow of drying air. The air heater 156 may be coupled in a similar fashion to an air temperature controller 160 (which may be separate from or defined by the same equipment as the air mass flow controller 158) that is in turn coupled to a sensor(s) 162 (such as a thermocouple) disposed at the outlet end 64 of the trough 52, which air temperature controller 160 may be programmed to vary the operation of the air heater 156 according to the temperature(s) within the material bed, for example.

The dryer 50 may also include a second source of heated air 170 that works in conjunction with the air exiting the hood 90, as well as other downstream exhaust air processing equipment 190. The second source of heated air 170 may include a fan 172, associated damper 174, air heater 176, an air mass flow controller 178, and air temperature controller 180 (which may be separate from or defined by the same equipment as the air mass flow controller 178). According to certain embodiments, the second source of heated air 170 may be adapted to deliver hot, temperature-controlled air at a constant mass flow directly to an exhaust air header to limit or prevent condensate formation in the exhaust system. The downstream exhaust air processing equipment 190 may include an exhaust air fan 192 that may be used to maintain a slight negative static pressure within the trough 52/hood 90 combination to limit expulsion of moisture and dust-laden air into the environment. The equipment 190 may also include a dust collector 194 with associated ancillary conveyors 196.

Figure 9:
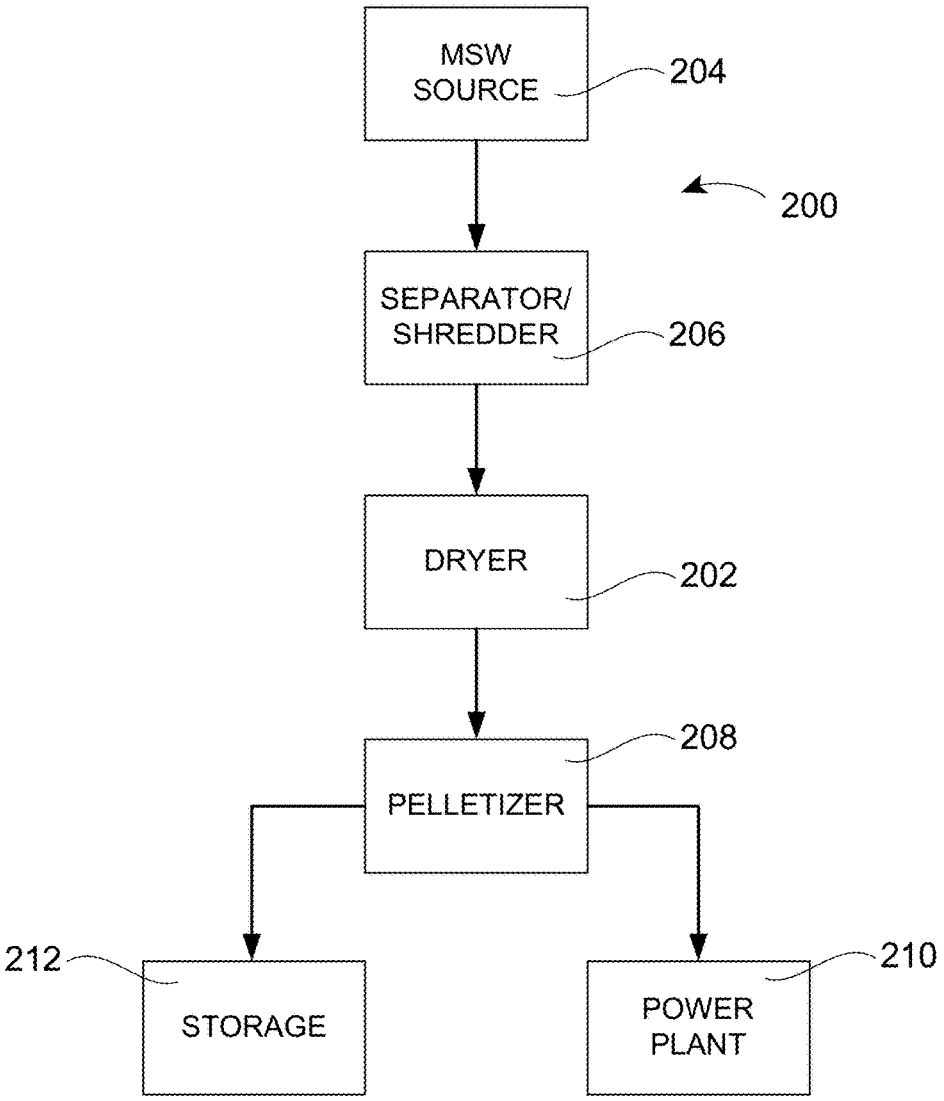
FIG. 9 is a schematic view of a system incorporating a dryer (or dryers) according to the present disclosure.

An exemplary system 200 utilizing the dryer according to the present disclosure is illustrated in FIG. 9. The system 200 includes a dryer 202, which dryer may be according to any of the embodiments addressed in the foregoing disclosure.

The dryer 202 receives MSW from a source 204, such as a dump or landfill. The material from the source 204 may be processed at 206 to separate metals, glass, rocks, concrete, and other debris, from the residual materials that are supplied to the dryer 202. A vibratory separator or other such equipment may be used to separate and remove the metals, glass, rocks, concrete, and other debris from the other MSW received from the source 204. The remaining MSW may also be shredded prior to being supplied to the dryer 202. For example, the dryer 202 may receive shredded remainder consisting, primarily, of paper and plastic, less than 2" in size.

Once the remaining MSW has been dried, the loose, dried material pelletized at 208, for example using a pellitizer that converts the loose, dried material into dense pellets of dried material. The pellets may then be transported to a power plant 210 (e.g., a coal-fired power plant), for use as a fuel supplement. As one alternative, the pellets may be transported to storage 212.

Figure 10:
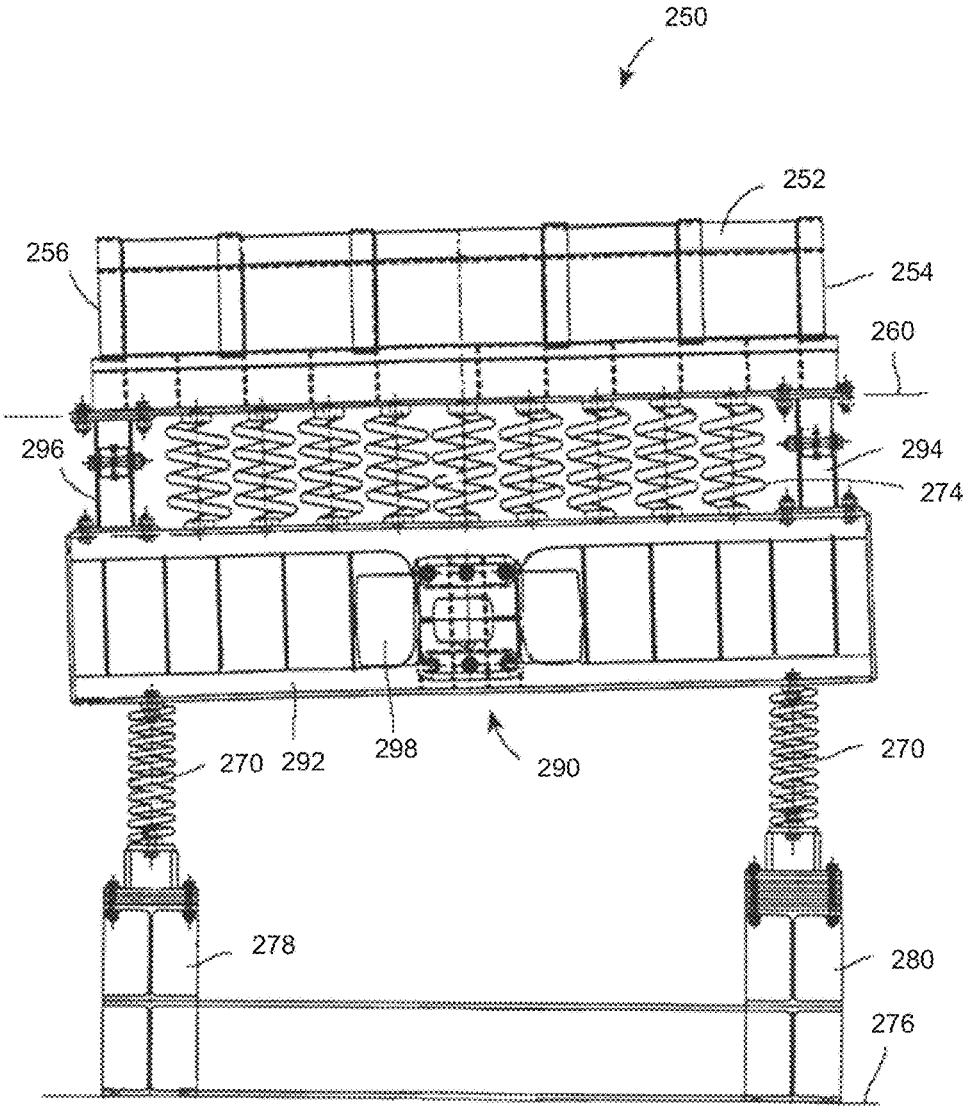
FIG. 10 is a front view of another vibratory dryer according to the present disclosure, with air plenum and exhausts removed.
Figure 11:
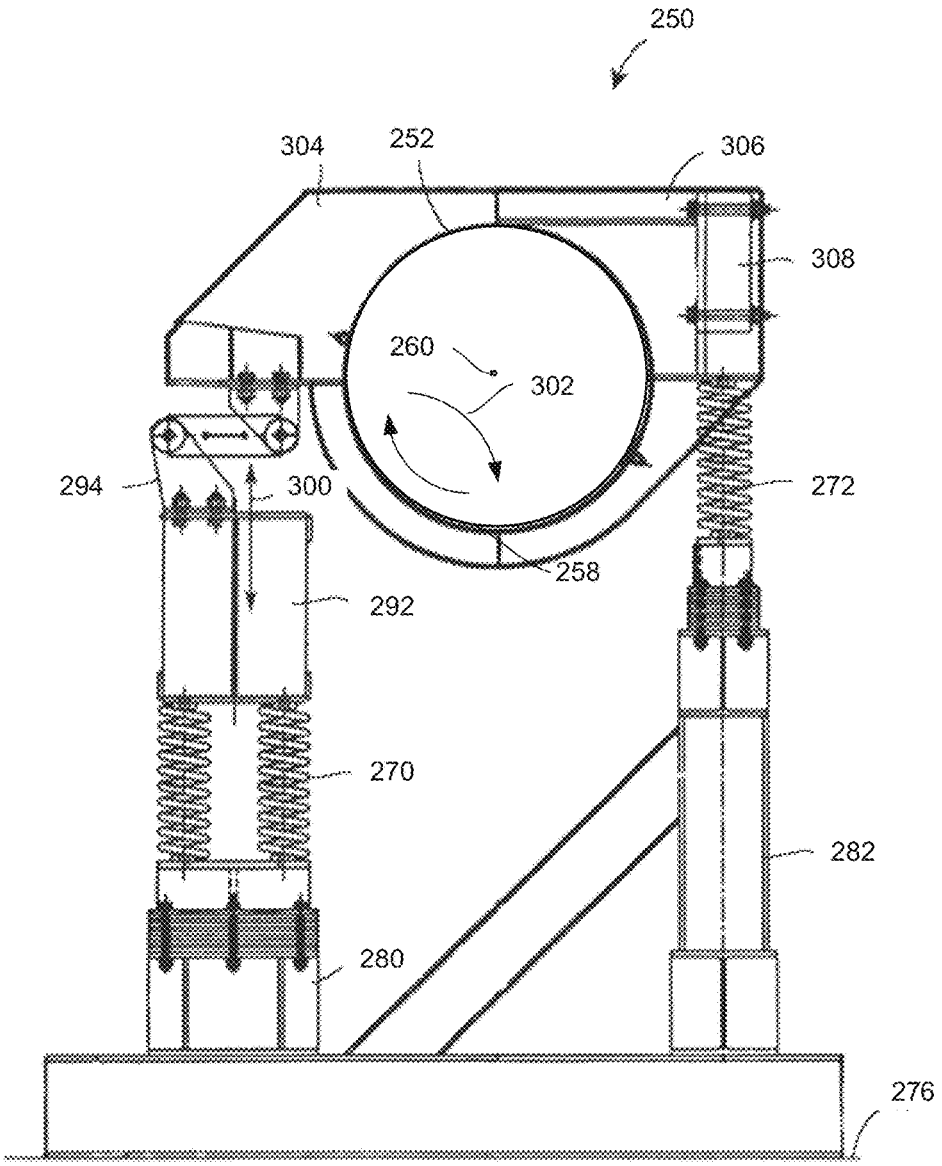
FIG. 11 is an end view of the apparatus of FIG. 10 with the mixing apparatus removed.
Figure 12:
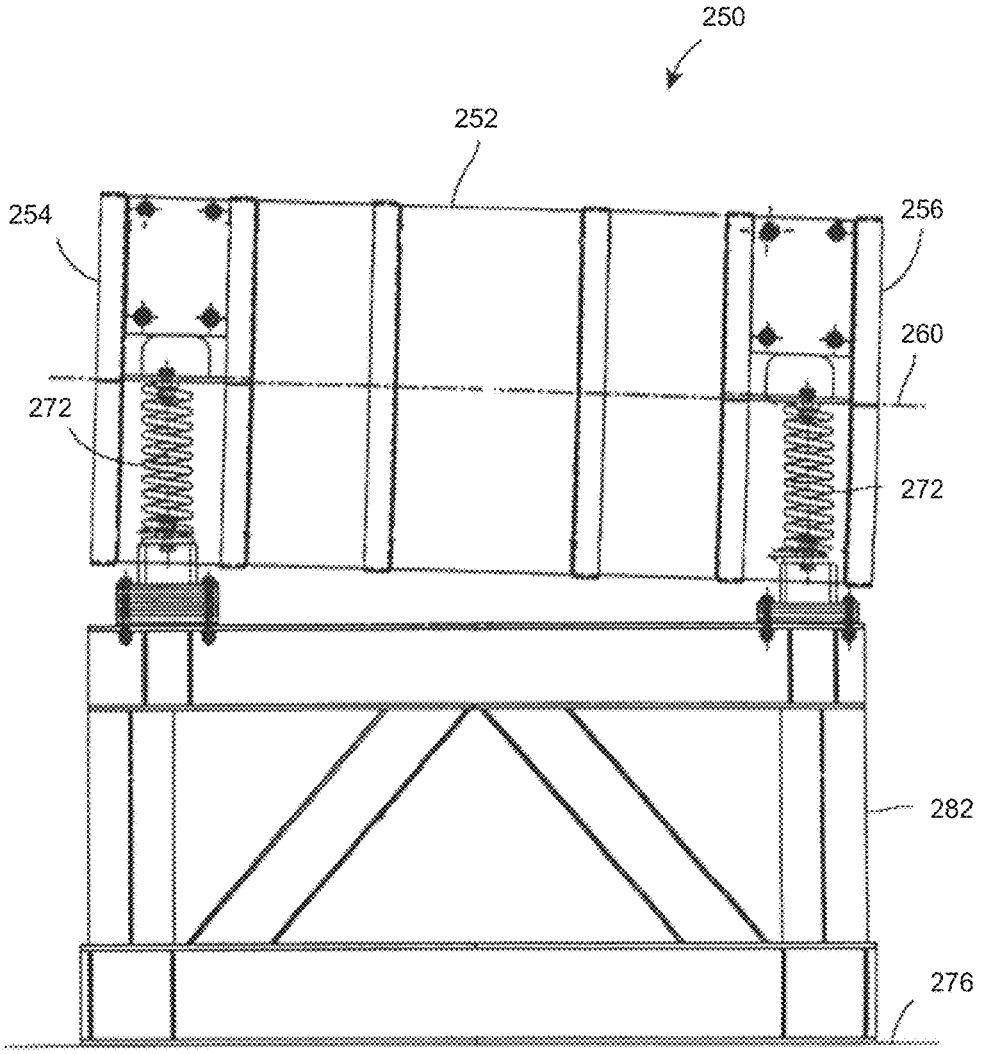
FIG. 12 is a rear view of the apparatus of FIG. 10.

A second embodiment of a vibratory dryer with mixing apparatus is illustrated in FIGS. 10-16. As illustrated in FIG. 10, a vibratory dryer 250 includes a cylindrical drum or container 252. The container 252 has an inlet end 254, and an axially-spaced outlet end 256 opposite the inlet end 254. As seen in FIG. 11, the container 252 has a curved inner surface 258 disposed about a generally horizontally extending longitudinal axis 260 (appearing as a point in FIG. 11, and as a line in FIGS. 10 and 12). The surface 258 may define a conveying surface for the materials disposed in the container 252.

The container 252 is mounted on a plurality of resilient members, or springs, 270, 272, 274 so as to be resiliently supported above a base 276. The springs 270 isolate the container 252 from the base 276 on one side, while the springs 272 isolate the container 252 from the base 276 on the other side. The springs 270, 272 may be set apart from the base 276 by, for example, steel columns 278, 280 (FIG. 10) and a steel support structure 282 (FIGS. 11 and 12), respectively.

The apparatus 250 also includes a vibratory generator 290. While an exemplary embodiment of a vibratory generator is discussed below, it will be recognized that other generators may be used as well. For example, an alternative generator may not have the motors mounted on the apparatus, but on a stationary support structure instead. The motors may be coupled to and drive rotating eccentric weights mounted on the apparatus, however.

Returning then to FIGS. 10 and 11, the vibratory generator 290 may comprise a beam 292 that spans the springs 270. The beam 292 is coupled to the container 252 by rocker leg assemblies 294, 296, disposed generally at or near the inlet end 254 and the outlet end 256, respectively. Rocker leg assemblies also may be distributed along the length of the beam 292. The beam 292 is also coupled to the container 252 by the springs 274, which springs 274 span the beam 292 between the rocker leg assembly 294 and the rocker leg assembly 296. In this manner, the container 252 has freedom of movement constrained only by the rocker leg assemblies 294, 296 and the springs 274 in response to a vibratory force produced by the vibratory generator 290. In addition, the vibratory generator 290 may include a pair of eccentric weight motors mounted on opposite sides of the beam 292, one of which is shown in FIG. 10 at 298.

The vibratory force produced by the vibratory generator 290 is generally represented by the double-ended arrow 300 in FIG. 11. It will be recognized that the vibratory force 300 is directed generally along a linear path which is (i) displaced from the generally horizontally extending longitudinal axis 260 and (ii) displaced from the center of gravity of the container 252. As will also be appreciated, the plurality of resilient members 270, 272, 274 mount the container 252 for unconstrained vibratory movement in response to the vibratory force 300 produced by the vibratory generator 290.

The vibratory force 300 causes objects to move within the container 252. Objects placed in the container 252 are moved in a generally rising and falling path of rolling movement along the curved inner surface 258 of the container 252, as generally represented by the pair of arrows 302 in FIG. 11. The rolling movement occurs as the objects are being transported in the direction of the generally horizontally extending longitudinal axis 260 from the inlet end 254 toward the outlet end 256 of the container 252.

To assist the movement of the objects along the axis 260, the container 252 may be mounted such that the generally horizontally extending longitudinal axis 260 is actually inclined downwardly from the inlet end 254 to the outlet end 256. The downward inclination of the container 252 causes the objects to be transported, in part, by gravity from the inlet end 254 toward the outlet end 256. However, it will be recognized that this inclination is not required in all embodiments of the present disclosure.

It will be recognized from FIG. 11, for example, that the container 252 may include a pair of outwardly extending arms 304, 306. The arms 304, 306 may each include an integrally associated ballast weight, such as the weight 308 (see FIG. 11) that is on the side of the container 252 opposite the vibratory generator 290. The ballast weights assist in producing the vibratory force 300, and the vibratory force 300 may be modified by modifying, for example, the placement and size of the ballast weights.

Figure 13:
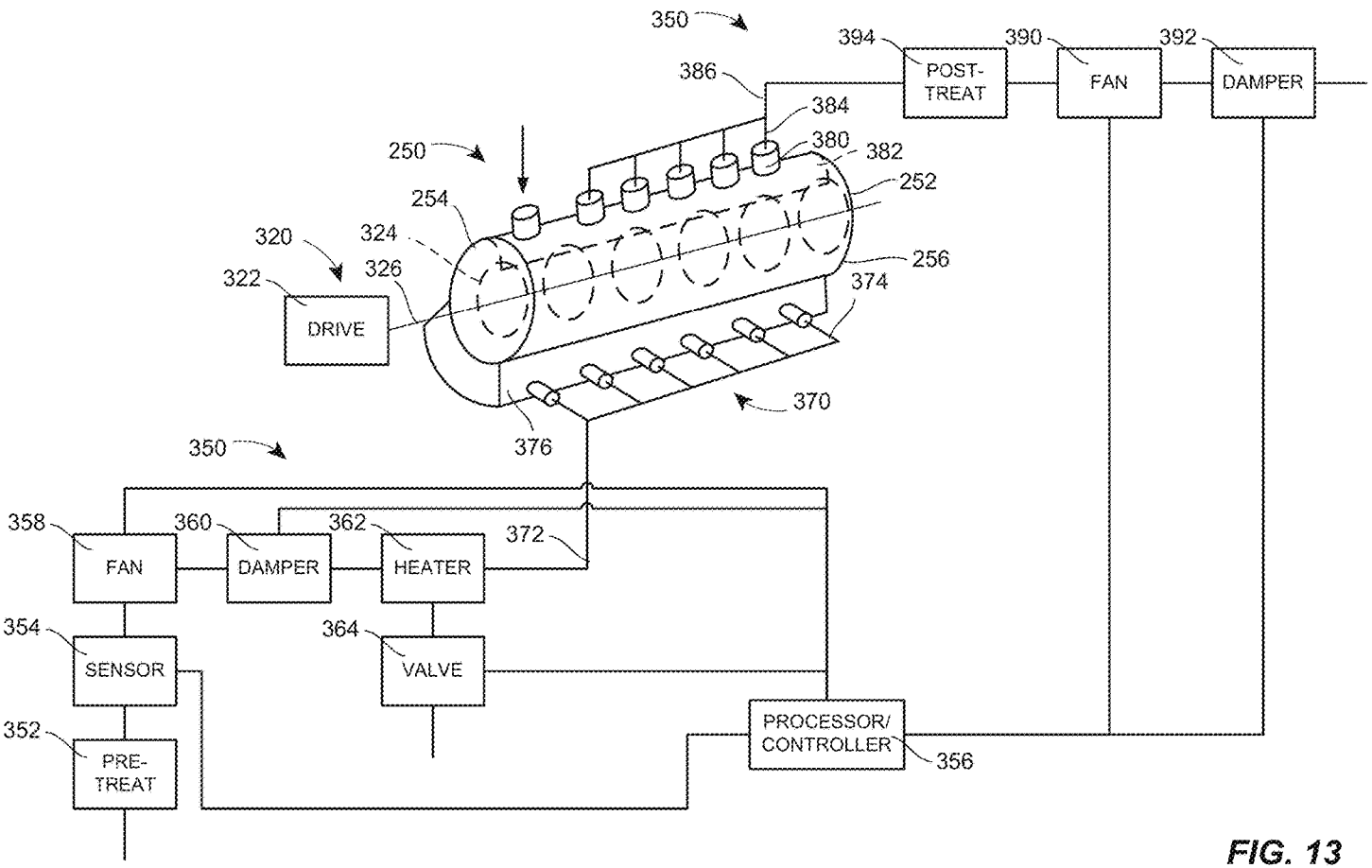
FIG. 13 is a schematic view of the dryer of FIG. 10, illustrating the source of heated air used in the dryer of FIG. 10.
Figure 14:
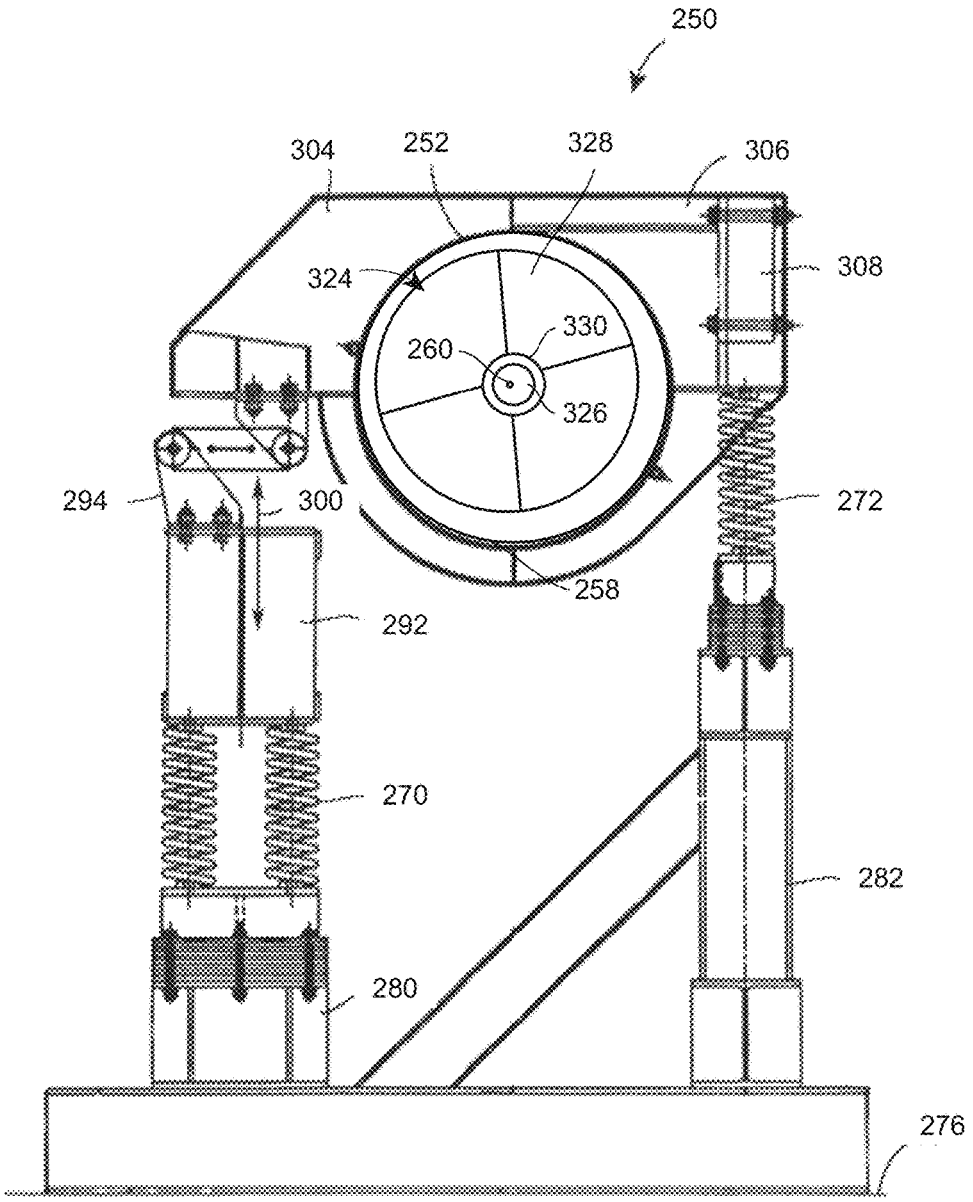
FIG. 14 is an end view of the apparatus of FIG. 10 with the mixing apparatus illustrated.

In addition to the motion produced in the material in the container 252 as a consequence of the vibratory force 300 produced by the vibratory generator 290, the dryer 250 may include one or more rotary mixer assemblies or mixers 320, as illustrated in FIGS. 13 and 14. As illustrated, the dryer 250 includes a single mixer 320. The mixer 320 may include a drive unit 322, which may include an electric motor and associated gearing or belts, that is coupled to one or more impellers 324 by a shaft 326. In the embodiment illustrated in FIG. 13, six impellers 324 are shown connected or coupled to the shaft 326.

As is also illustrated, the length of the shaft 326 may be such that the drive unit 322 of the mixer 320 may be disposed outside the container 252. For example, one or both ends of the shaft 326 of the mixer 320 may be mounted on a cross beam or cross beams, which beam or beams may be connected to ground, and the shaft 326 may pass through the inlet end 254 and/or the outlet end 256 (that is to say, the shaft 326 may be supported at one end or both ends of the dryer 250 by the cross beam or beams). As illustrated in FIG. 13, both ends of the shaft 326 are supported (by bearings, for example) outside the dryer 250. According to certain embodiments, the shaft 326 may be mounted on a spring-supported, weighted base to minimize the impact forces between the mixer 320 and the drum 252 due to material compression between the mixer 320 and the surface 258. A seal may be formed at each of the inlet and outlet ends 254, 256 through which the shaft 326 may pass.

The drive unit 322 causes the shaft 326 to rotate about its axis, causing the impellers 324 of the mixer to likewise rotate about a shaft axis, which shaft axis may be substantially parallel to the axis 260 of the container 252. The axis of the shaft 326 may be offset relative to the axis 260, or the axis of the shaft 326 may be aligned with the axis 260. The impeller 324 may rotate at a different speed than the rolling motion of the material in the container 252 caused by the force 300, which may cause relative motion between the impeller 324 and the material in the container 252. Because the shaft 326 is coupled to ground and the inner curved surface 258 (along with the remainder of the drum 252) is moving according to a vibratory motion, the impeller 324 may also have a tendency to move relative to the surface 258 through the bed of material disposed on the surface 258 as a consequence. Additionally, as the heated air passes through the bed of material (explained in greater detail below), the air flow may cause the materials to shift, which may also cause relative movement between the impeller 324 and the materials within the drum 252.

The mixers 320 are intended to rotate slowly relative to the motion of the material according to the motion produced by the vibratory generator 260 to produce an uplift of the material (e.g., MSW) to mix the constituent materials within the bed without centrifugally displacing the material. As a consequence, the distribution of heated air remains relatively uniform. The uniform distribution of the heated air is believed to play a significant role in achieving uniform constant rate drying.

The impeller 324 may be constructed as illustrated in FIG. 14. That is, the impeller 324 may include four blades or paddles 328 attached or secured to a central hub 330 that is attached or secured in turn to the shaft 326. The blades or paddles 328 may be flat (to promote axial movement) or may have an arcuate shape, similar to that seen in FIG. 5, and may be equally disposed about the hub 330, again similar to that seen in FIG. 6. As such, the impeller 324 and the blades 328 of the impeller will be disposed generally orthogonal to the axis of the shaft 326, and potentially orthogonal to the longitudinal axis as well. It will be recognized that this embodiment of the mixer 320 is merely for illustrative purposes only, and does not limit the mixer 320 according to the present disclosure to only the embodiment illustrated in FIGS. 13 and 14.

According to the present embodiment, the mixer 320 may include more than one impeller 324 (e.g., six impellers, as illustrated). The impellers 324 may be disposed at intervals along the shaft 326 between the inlet and outlet ends 254, 256. In fact, the impellers 324 may be spaced at equal intervals along the shaft 326 (as illustrated), or the impellers may be disposed along the shaft 326 such that certain ones of the impellers 324 are closer to each other than other ones of the impellers 324 (i.e., unequal).

It may also be possible to use more than one mixer, each mixer having a separate shaft and separate impellers. The number of impellers mounted on the shaft of the mixers may vary. In addition, the impellers of one mixer may be spaced in different points along the respective shaft when compared with the impellers spaced along the shaft of another mixer, such that the impellers do not interfere with each other, although the motion of the impellers of different mixers may cooperate with each other relative to the motion of the material in the container 252. Also, the shafts of the mixers may be spaced so that the impellers of one mixer do not contact the shaft of another mixer.

Moreover, the mixer or mixers may rotate at different speeds or in different directions, so as to cause different motions within the material in the drum 252 or in different regions within the container. For example, the direction of rotation of a mixer may be alternated to cause the material to move axially back and forth to improve the mixing, in a batch process for example. Adjustable rotation of the mixers (as to speed and direction of the mixers, and also of the blades relative to the shaft) may facilitate the adjustment of the operation of the mixers and the resultant mixing produced thereby to address variations in the material entering or passing through the container, for example, which adjustments may be automated in certain embodiments. As to those embodiments where different motion is caused in different regions of the container, the different regions with different motions may be axially spaced from each other between the inlet and outlet ends 254, 256 of the drum 252. Other variations are also possible.

Reference is now made to FIG. 13, wherein the drum 252 of the dryer 250 is illustrated in combination with a fluid flow system or a source of heated air 350. To simplify the illustrations, only the drum 252 of the apparatus 250 is illustrated in FIG. 13. However, it should be recognized that the apparatus 250 would be assembled in accordance with the disclosure of FIGS. 10-12, and that the plenums, exhausts and other elements of the heated air source 350 would be assembled so as to permit the apparatus 250 to operate as discussed above.

According to the exemplary embodiment illustrated in FIG. 13, the working fluid used in the heated air source 350 is air. Other gaseous fluids may be used in alternative embodiments. However, it is believed that air may be a suitable fluid to be used in accordance with the apparatus 250 and source 350.

Air is drawn into the source 350 through a pretreatment stage 352. The pretreatment stage 352 may include a filter, for example. The filter may be selected according to the desired characteristics of the air that will be introduced into the drum 252. For that matter, other equipment may be included in the pretreatment stage, such as dehumidifiers and the like.

Air passes from the pre-treatment stage 352 through a sensor or monitor 354. The sensor 354 is coupled to a processor/controller 356. The sensor 354 provides a signal to the processor/controller 356 representative of the flow of the air through the sensor 354.

The air is drawn into a fan 358, the output of which is coupled a damper 360. The combination of the fan 358 and the damper 360 force air into the drum 252, as explained in greater detail below. The fan 358 and/or the damper 360 are connected to the processor/controller 356, and the processor/controller 356 may adjust the fan and/or the damper 360 in response to the signals received from the sensor/monitor 354. Alternative mechanisms for providing a controlled air stream may be substituted for this exemplary combination; for example, a variable frequency drive (VFD) may be used in conjunction with the fan 358 to control the speed of the fan 358 to control the flow of air into the drum 252.

The air passing the damper 360 is received by a heater 362. The heater 362 increases the temperature of the air in preparation for its introduction into the drum 252. The heater 362, or a valve 118 in a fuel line connected to the heater 362, may be connected to the processor/controller 356. The processor/controller 356 may also be coupled to a temperature sensor disposed at the output of the heater 362 and to a temperature sensor disposed within the drum 252. The processor/controller 356 controls the valve 118 in accordance with the signals received from the temperature sensors.

The output of the heater 362 is directed into a conduit or a plurality of conduits 370. As illustrated, the plurality of conduits 370 includes a main conduit 372 from which a number of auxiliary conduits 374 depend. The auxiliary conduits 374 are coupled to a plenum 376, which is disposed beneath and coupled to the drum 252. Because of the motion of the drum 252, one or more flexible couplings are used in the main conduit 372 or auxiliary conduits 374. One or more dampers may also be disposed in the auxiliary conduits 374 to provide further control of the air entering the plenum 376.

Figure 15:
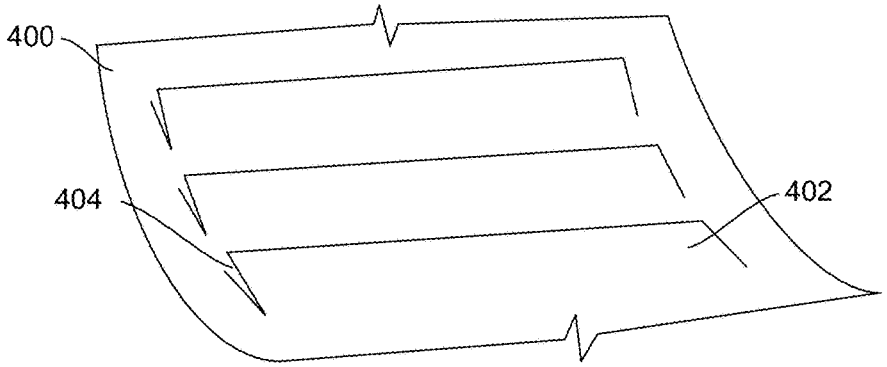
FIG. 15 is a fragmentary, perspective view of a mechanism for creating tangential air flow along the surface of the drum of the dryer of FIG. 10.
Figure 16:
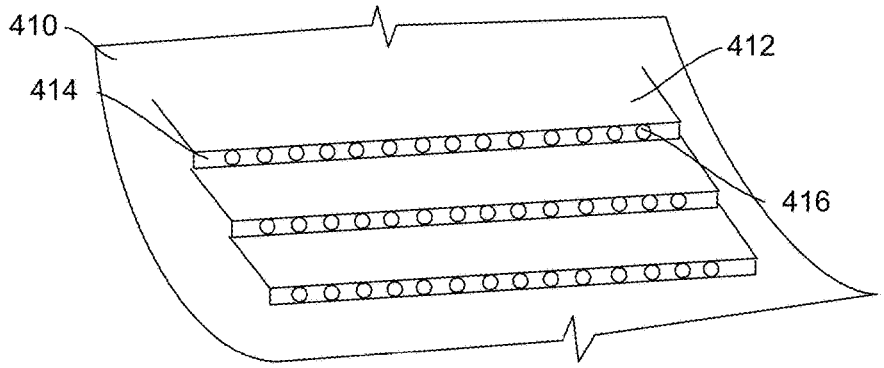
FIG. 16 is a fragmentary, perspective view of another mechanism for creating tangential air flow along the surface of the drum of the dryer of FIG. 10.

The plenum 376 may include a plurality of separate chambers, each associated with one of the auxiliary conduits 374. The air from the plenum 376 is, in turn, may be passed into the drum 252. In fact, the air may pass into the drum 252 through a mechanism for creating tangential air flow along the surface of the drum 252, although such a mechanism is not required according to all embodiments of the present disclosure. Two such mechanisms for creating tangential air flow are illustrated in FIGS. 15 and 16. FIG. 15 illustrates a deck plate 400 including a plurality of louvers 402 that define a plurality of slot-like apertures 404. The deck plate 400 is oriented in the direction that it might be disposed within the drum 252 as the drum 252 is illustrated in FIG. 13. FIG. 16 illustrates a deck plate 410 including a plurality of steps 412 having a surface 414 in which a plurality of hole-like apertures 416 is formed. The deck plate 410 is reversed relative to the direction in which it would be oriented when disposed within the drum 252 of FIG. 13 so as to better illustrate the apertures 416.

Air is removed from the drum 252 through one or more exhausts 380. To guide or direct the air into these exhausts, a deflector 382 is disposed in the drum 252. The deflector 382 is coupled to the surface of the drum longitudinally, and may have an arcuate or curved cross-section as viewed from the end of the drum 252. The deflector 382 may create a centrifugal force on the particulate suspended in the air stream to direct the particulate back to the bed of material in the drum 252, with the air reversing direction to enter the exhausts 380. The exhausts 380 are coupled to a plurality of auxiliary conduits 384 that feed into a main conduit 386.

A fan 390 and associated damper 392 are used to remove a controlled air stream from the drum 252 through the exhausts 380 and conduits 384, 386. Similar to the fan 358 and damper 360, the fan 390 and/or damper 392 may be coupled to the processor/controller 356. The processor/controller 356 is also coupled to a static pressure sensor disposed within the drum, and controls the fan 390 and/or damper 392 to adjust the flow of air exiting the drum 252 so as to maintain, for example, a slight negative pressure within the interior of the drum 252 to limit the release of hot air and/or particulate into the operating environment about the source 350, and particularly the drum 252. Here as well, alternatives are possible for the combination of fan 390 and damper 392, such as the use of a variable frequency drive (VFD) with the fan 390.

As also illustrated, a post-treatment stage 394 may be disposed upstream of the fan 390. Such a post-treatment stage 394 may include a heat exchanger to reduce the temperature of the air stream exiting the source 350. Such a post-treatment stage 394 may also include a cyclonic dust separator, fabric-type dust collector or other dust collection technology to remove debris that may have become entrained in the air stream as the air passes through the interior of the drum 252, as may be required by local environmental requirements for example.

In operation, heated air is forced into the drum 252 through the mechanisms for creating tangential air flow. At the same time, the material in the drum 252 is following a rolling motion in accordance with the action of the vibratory generator 290. The tangential air flow is thus in the same clockwise direction as the motion of the material within the drum 252, as illustrated in FIG. 11.

It is believed that the heated air entering the drum in a tangential flow direction may have at least two effects on the motion of the material in the drum 252. First, the air flow reinforces the rolling motion of the material in the drum 252. Second, the air flow assists in the mixing of the material in the drum 252.

It is believed that these motion patterns may have several benefits, one or more of which may be present in an embodiment according to the present disclosure. The mixing of the material prevents "slugging" of the material in the drum 252. The prevention of slugging contributes to a more even distribution of temperature in the material in the drum 252, and a more even distribution of moisture as a consequence.

Although the preceding text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Moreover, while the foregoing was discussed relative to a mixed solid waste stream of paper, glass containers, metal containers and plastic containers, it will be recognized that the usefulness of the foregoing dryer is not limited to the materials discussed herein.

What is claimed is:

1. A vibratory dryer comprising:

a conveying surface over which a bed of materials to be dried is conveyed, the surface having an inlet end and an outlet end, and passages through which air passes through the conveying surface to pass through the bed of materials on the conveying surface;

a source of heated air coupled to the passages in the conveying surface to supply heated air to the bed through the passages;

a vibration generator coupled to the conveying surface and adapted to move the materials along the conveying surface between the inlet end and the outlet end; and at least one rotary mixer having an impeller spaced from the conveying surface at a distance so as to be disposed within the bed of materials, the at least one rotary mixer disposed along the length of the conveying surface between the inlet end and the outlet end, the impeller mounted on a shaft that is coupled to ground separately from the conveying surface such that the conveying surface is allowed to vibrate relative to the impeller, the at least one rotary mixer adapted to provide uplift within the bed without de-densification of the bed through slow rotation relative to the motion of the material caused by the vibration generator.

2. The vibratory dryer according to claim 1, further comprising: a container with a curved inner surface disposed about a generally horizontally extending longitudinal axis that defines the conveying surface, an inlet end and an outlet end that define the inlet end and the outlet end of the conveying surface, and at least one deck plate with apertures that define the passages, wherein the source of heated air is coupled to the apertures in the at least one deck plate to supply heated air to the bed through the apertures; and wherein the vibration generator produces a vibratory force to cause the material within the container to be moved in a generally rising and falling path of rolling movement along the curved inner surface.

3. The vibratory dryer according to claim 2, wherein the at least one rotary mixer is directed along an axis that is parallel or coincident to the longitudinal axis of the container.

4. The vibratory dryer according to claim 3, wherein the shaft has a shaft axis that is parallel or coincident to the longitudinal axis of the container.

5. The vibratory dryer according to claim 4, wherein the at least one rotary mixer comprises a plurality of impellers, the impellers disposed at intervals along the shaft between the inlet and outlet ends of the container.

6. The vibratory dryer according to claim 5, wherein the impellers are spaced at equal intervals along the shaft.

7. The vibratory dryer according to claim 5, wherein the impellers are disposed orthogonal to the shaft axis.

8. The vibratory dryer according to claim 5, wherein each impeller comprises a plurality of blades, each of the blades attached to a hub that is attached to the shaft.

9. The vibratory dryer according to claim 2, wherein the deck plate has apertures that direct the air tangential to the inner curved surface.

10. The vibratory dryer according to claim 9, wherein the deck plate comprises louvers or steps that define the apertures that direct the air tangential to the inner curved surface.

11. The vibratory dryer according to claim 1, further comprising: a trough that defines the conveying surface, the trough having an inlet end and an outlet end that define the inlet end and the outlet end of the conveying surface and at least one deck plate with apertures that define the passages; wherein the source of heated air is coupled to the apertures in the at least one deck plate to supply heated air to the bed through the apertures; and wherein the at least one rotary mixer comprises a plurality of rotary mixers each having an impeller spaced from the trough at a distance so as to be disposed within the bed of materials formed in the trough, the plurality of rotary mixers also disposed along the length of the trough between the inlet end and the outlet end, the plurality of rotary mixers adapted to provide uplift within the bed without de-densification of the bed.

12. The vibratory dryer according to claim 11, wherein the trough has a deck and side walls depending from the deck, and the impellers are spaced from the deck at a height so as to be disposed within the bed of materials formed in the trough.

13. The vibratory dryer according to claim 12, wherein the plurality of rotary mixers comprise a plurality of rows, the individual rows spaced between the inlet end and the outlet end of the trough and the impellers of the individual mixers within each row spaced between the side walls of the trough.

14. The vibratory dryer according to claim 11, wherein the impeller moves in a plane that is substantially parallel to the conveying surface.

15. The vibratory dryer according to claim 11, wherein the trough has a deck and side walls depending from the deck, the passages disposed through the deck, and further comprising: a plenum disposed beneath the deck and in fluid communication with the source of heated air and the passages in the deck.

16. The vibratory dryer according to claim 15, wherein the trough further comprises a hood disposed above the deck and attached to the side walls, the hood having at least one passage through which air exits.

* * * * *